United States Patent [19]

Williams

[11] 4,055,307

[45] Oct. 25, 1977

[54] MATERIAL PROCESSING APPARATUS

[75] Inventor: Robert M. Williams, Ladue, Mo.

[73] Assignee: Williams Patent Crusher and Pulverizer Company, St. Louis, Mo.

[21] Appl. No.: 714,623

[22] Filed: Aug. 16, 1976

[51] Int. Cl.[2] ..... B02C 23/14

[52] U.S. Cl. ..... 241/48; 241/77; 241/81; 241/DIG. 38

[58] Field of Search ..... 241/48, 57, 59, 77, 241/81, DIG. 38

[56] References Cited

U.S. PATENT DOCUMENTS

| | | | |
|---|---|---|---|
| 1,116,777 | 11/1914 | Williams | 241/48 |
| 1,312,658 | 8/1919 | Williams | 241/48 |
| 3,702,682 | 11/1972 | Williams | 241/48 |

*Primary Examiner*—Granville Y. Custer, Jr.

*Attorney, Agent, or Firm*—Gravely, Lieder & Woodruff

[57] ABSTRACT

Apparatus for processing material to reduce it to a state that renders the material more easily disposed of, the apparatus being adapted to process all types of refuse and garbage of the character usually collected by packer trucks from residential and commercial areas in particular.

8 Claims, 1 Drawing Figure

MATERIAL PROCESSING APPARATUS

BACKGROUND OF THE INVENTION

The ever mounting volume of trash has posed a serious community problem of how best to dispose of such discardable material without contaminating the surrounding area with air borne matter. The material most troublesome is the type of discardables collected by packer trucks which includes garbage and decaying matter, along with a mixture of metallics and non-metallics of various sizes and hardness. Some of the hard trash can be singled out on the basis of specific gravity, such as non-grindables, some may be ground to a more managable size for disposal by burning, some may be of such low specific gravity as to be easily floated off for separate collection, and some material may be non-burnable but not detrimental to equipment used to burn what can be disposed of in that manner to produce valuable heat values.

BRIEF DESCRIPTION OF THE INVENTION

This invention relates to material processing apparatus, and more particularly to apparatus having an arrangement of components which renders the processing of waste material more efficient.

The preferred embodiment of this invention comprises a rotary hammer mill connected into a housing which receives the material to be processed and initiates the sorting of such material into fractions to be reduced by the mill, fractions which separate out on the basis of high specific gravity, and fractions of low specific gravity, and a system of conduits, blowers and separators associated with the mill and housing arranged to sort out the material in a predetermined manner. The apparatus representing the preferred embodiment operates to separate the light weight, fluffy fractions so such material does not need to pass through the mill, and the high specific gravity fractions also are separated out when not grindable.

DETAILED DESCRIPTION OF THE EMBODIMENT

Figure 1:
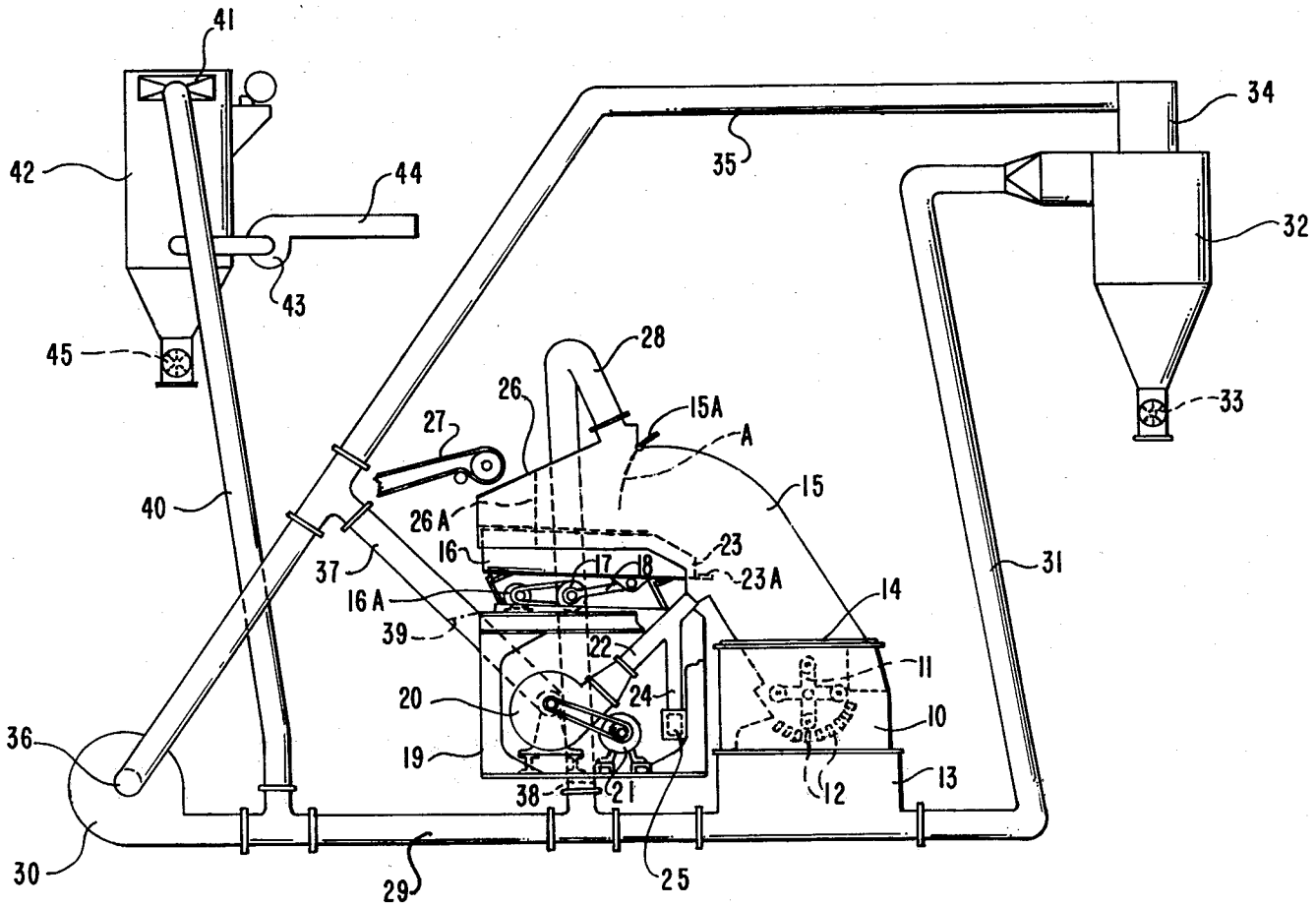

The preferred embodiment of this invention is shown in a single schematic view in the accompanying drawing.

A rotary hammer mill is represented by the mill casing 10 in which the hammer rotor 11 is operatively mounted above an outlet formed by a plurality of grate bars 12 disposed around the path of the hammers. The outlet is enclosed in a discharge chamber 13, while the inlet to the mill casing 10 is connected to the outlet 14 formed at the lower end of a housing 15 which extends above the mill and encloses a vibratory or material agitating conveyor 16 having an operating motor 16A driving an eccentric 17 and a drive arm 18. The conveyor 16 is supported on a base frame 19 which houses an air moving blower 20 driven by motor 21. The blower outlet conduit 22 is directed into the housing 15 at a location below the material fall-off lip 23 of the conveyor 16. The blower outlet conduit 22 is open intermediate its length to a collection conduit 24 for tramp material having a high specific gravity like chunks of metal, stones, bricks and similar solids. The lip 23 is provided with spaced tines 23A to prevent over-size material from falling into the conduit 22 where it could choke conduit 24. The tines thus cause such material to fall into the mill 10. The conduit 24 has a bottom air seal flap 25 which allow exit of material but restricts air inflow.

The material to be processed by the apparatus is brought to the inlet opening 26 of the housing 15 by a suitable conveyor 27 and dropped into the housing over the vibratory or agitator conveyor 16. The inlet 26 is provided with an air seal curtain 26A which limits the amount of air carried in with the feeding of the material to be processed. A hinged apron A with a position adjusting handle 15A is mounted in the upper part of the housing to block the material flung up by the mill from interferring with the material entering the inlet 26. Often times non-grindables will be found in the trash, and such items will be rejected by the mill 10 by being flung out along the curved wall of housing 15 and directed by the apron A into the conveyor 16 where it can fall into the conduit 24. The mill acts on the non-grindables, such as metals, to ball them up so they are less responsive to the air flow in conduit 22 and can easily fall into conduit 24. At a suitable top location over the conveyor 16, the housing 15 is formed with a connection for an outlet conduit 28. The conduit 28 is connected into the discharge conduit 29 of a blower 30, such conduit 29 being connected into the mill discharge chamber 13. Mill outlet chamber 13, in turn, is connected by a conduit 31 into a conventional cyclone separator 32 which is provided with a material outlet rotary valve 33 and a cleaned air outlet cupola 34. The cupola 34 is connected by a conduit 35 to the suction inlet 36 for the blower 30, and a branch conduit 37 leads off conduit 35 to the suction inlet for the blower 20.

While the foregoing has described the principal components of the apparatus, there is a further important feature in the conduit 40 which connects into the conduit 29 on the discharge side of blower 30 and leads into the inlet 41 of a bag house 42 where the dust and extremely fine particles are captured outside the bags, while the air is drawn through the bags by the blower 43 and discharged through conduit 44 to ambient space.

Regulation of the air movement associated with the apparatus is provided by replacement of a valve 38 in the conduit 28, and by placing a second valve 39 in the conduit 37 leading to the blower 20. Valve 38 regulates the flow in by-pass of the mill 10, and valve 39 is set to obtain the desired air velocity in conduit 22 so that non-grindables and tramp material can fall counter to the current and pass through conduit 24 for discharge at the air seal flap 25.

The material discharged at the rotary valve 33 for the cyclone separator is the primary material to be disposed of, either by burning or by other methods. The dust and fines collected in the bag house 42 is discharged at rotary valve 45.

It can be appreciated that the blower 30 has the principal job of furnishing a sufficient flow of air in conduit 29 to move the material in the discharge chamber 13 to the separator 32 and to cause the separator to function normally so that the material conveyed thereto through conduit 31 is capable of being discharged at the valve 33 while air substantially free of material is returned through conduit 35. Accordingly, the capacity of the blower 30 is of the order of 1500 CFM/TON of the solids in the airstream, producing air movement in conduit 29 of the order of 5000 FPM. This capacity is sufficient to supply the suction side of blower 20 so that the flow in conduit 22 can be of the order of 4000 to 5000 CFM. While the blower 20 depletes the suction to blower 30, it is observed that the conduit 28 does act to return a portion of the air to the conduit 29.

The flow in the system above described is caused to operate under a negative pressure due to the operation of the baghouse blower 43 drawing off a portion of the air flow in conduit 29 to the extent of about one-third of the capacity of the fan 30 which results in the negative pressure condition.

OPERATION OF THE APPARATUS

Assuming that the several blowers 20, 30 and 43 are operating, and the motor 16A for the conveyor 16 is also operating, material to be processed is dumped through the inlet 26 past the air seal curtain 26A and into the vibrating conveyor 16 where the light weight, fluffy fraction is subjected to the suction effect at the top conduit 28, while the remainder is subjected to the effect of the air movement through the mill 10 and discharge chamber 13 to conduit 31. Such remainder material is first subjected to the vibratory or agitating action of conveyor 16 and the air flow across the drop off lip 23. The majority of the material will move to the mill 10 and be ground up by the hammers on the rotor 11, the heavy chunks of trash will fall into the discharge conduit 24 and in the fall will be scrubbed by the air flow in conduit 22 to separate material responsive to the air velocity. Regulation of the air velocity in conduit 22 is effected by the valve 39 in conduit 37.

As the mill 10 grinds the material it will be transported by conduit 31 to the cyclone separator 32 by the air supplied by blower 30 through conduit 29. The air cleaned by the cyclone will return by conduit 35 to the blower, except that the necessary volume of that return air is sucked off by blower 20 for supplying air to conduit 22 for the above noted purposes. The possibility of dust and fine fluffy material contaminating the space adjacent the apparatus is substantially avoided by the conduit 40 connecting the baghouse 42 into the system. The baghouse blower 43 bleeds off air from the system of conduits 29 and 35 across the blower 30 and lowers the pressure therein to less than ambient pressure so the apparatus is under a negative pressure condition.

An important feature of the apparatus is the provision of the conduit 28 which acts as an air by-pass around the mill 10, and can be regulated by the valve 38. Should the mill 10 become chocked with material, the air movement will not cease due to the by-pass safety conduit 28. Eventually the mill will clear any such chock-up and the apparatus will resume its normal operation. Another important feature of the apparatus is in the action of the mill 10 to disassociate non-crushables or non-gridables from the other material by flinging such non-crushable material out to be guided by the curved wall of housing 15 and the adjustable apron A back to the conveyor 16 where it can fall into conduit 24 and pass out at the air seal flap 25.

What is claimed is:

1. Material processing apparatus comprising: a housing having a material inlet and an outlet; a material reducing mill connected into said housing at said outlet and said mill having a discharge chamber for reduced material; reduced material separator means having an inlet connected into said discharge chamber and also having an outlet; air moving means having a suction inlet connected to said outlet of said separator means and a discharge connected to said discharge chamber, the air from said air moving means transporting the reduced material to said separator means and returning air from said separator means outlet to said air moving means; conduit means connecting said housing into said air moving means discharge in advance of said discharge chamber to by-pass said mill, whereby material in said housing is continually transported to said separator means through said discharge chamber, and means connected into said air moving means discharge in advance of said connection to said discharge chamber to reduce the pressure in the apparatus to less than ambient.

2. The apparatus set forth in claim 1, wherein said pressure reducing means includes dust collecting means having an inlet connected to said air moving means discharge and an outlet; and second air moving means connected to said last mentioned outlet and exhausting air to ambient atmosphere.

3. Material processing apparatus comprising: a housing having an inlet for material to be processed and separate outlets spaced from said inlet; a material reducing mill having an inlet connected to a first one of said housing outlets and an outlet for reduced material; a vibratory conveyor in said housing below said housing inlet to receive material and move it to a drop-off end spaced above a second one of said separate outlets; a receiving conduit connected into said second one of said separate outlets to receive material falling from said conveyor drop-off end; a first blower having a discharge connected to said mill outlet; a cyclone separator connected to said mill outlet and having a material discharge and an air discharge; conduit means connecting said cyclone air discharge into said first blower thereby completing a circulating path from said first blower through said mill outlet to said cyclone separator to move reduced material and to move air back to said first blower via said conduit means; a second blower having an inlet connected into said conduit means and an outlet connected into said receiving conduit to direct air against material falling into said receiving conduit from said drop-off end of said vibratory conveyor; and a by-pass conduit connected into a third one of said housing outlets and said first blower discharge in advance of the connection to said mill outlet, whereby choking of said material reducing mill is alleviated by movement of airborne material in said by-pass conduit.

4. The apparatus set forth in claim 3, wherein means is connected into said first blower discharge in advance of said by-pass conduit to draw off air circulated by said first blower to reduce the pressure in said circulating path to less than ambient pressure.

5. The apparatus set forth in claim 4, wherein said pressure reducing means includes a baghouse and a baghouse blower connected in series whereby fines from said circulating path are collected and said baghouse blower discharge to ambient substantially free of fines.

6. The apparatus set forth in claim 3, wherein valve means is operatively positioned in the apparatus to regulate the flow in said second blower outlet and in said by-pass conduit.

7. The apparatus set forth in claim 3, wherein material size limiting means is carried by said vibratory conveyor at said drop-off end in position to prevent material falling into said receiving conduit of a size to choke said receiving conduit.

8. The apparatus set forth in claim 7, wherein said housing is formed with a wall above said material reducing mill to direct non-grindable material back into said vibratory conveyor in partly reduced condition capable of passing said size limiting means to fall into said receiving conduit, thereby separating non-grindable material from the rest of the material.

* * * * *